United States Patent [19]

Verstijnen

[11] Patent Number: 4,580,868

[45] Date of Patent: Apr. 8, 1986

[54] KEYING SYSTEM FOR ELECTRICAL CONNECTORS

[75] Inventor: Renoldus J. J. M. Verstijnen, Boxtel, Netherlands

[73] Assignee: AMP Incorporated, Harrisburg, Pa.

[21] Appl. No.: 586,466

[22] Filed: Mar. 5, 1984

[51] Int. Cl.[4] ..... H01R 13/645

[52] U.S. Cl. ..... 339/186 M; 339/276 SF

[58] Field of Search ..... 339/186 R, 186 M, 184 R, 339/184 M, 276 SF

[56] References Cited

U.S. PATENT DOCUMENTS

| | | | |
|---|---|---|---|
| 3,287,031 | 11/1966 | Simmons et al. | 339/186 R |
| 3,299,395 | 1/1967 | De Mare | 339/186 R |
| 3,474,395 | 10/1969 | Ferdon et al. . | |
| 3,818,280 | 6/1974 | Smith et al. | 317/101 |
| 4,227,762 | 10/1980 | Scheiner | 339/186 M |
| 4,354,724 | 10/1982 | Jarmy | 339/186 |
| 4,376,565 | 3/1983 | Bird et al. | 339/186 |
| 4,398,779 | 8/1983 | Ling | 339/17 |
| 4,449,767 | 5/1984 | Weidler | 339/186 M |

FOREIGN PATENT DOCUMENTS

| | | | |
|---|---|---|---|
| 2807017 | 8/1979 | Fed. Rep. of Germany | 339/186 M |

*Primary Examiner*—John McQuade
*Assistant Examiner*—Thomas M. Kline
*Attorney, Agent, or Firm*—Frederick W. Raring

[57] ABSTRACT

First and second connector housings are keyed to each other by means of identical parts which can serve as either keys or keyway plugs. The identical parts are produced as a continuous strip comprising a carrier strip from which the parts extend at spaced apart intervals. In the practice of the invention, a section of strip is used which has a number of parts thereon equal to the number of keying positions in the connector assembly. One or more of the identical parts are removed from the strip and assembled to the first housing. Thereafter the remaining parts on the strip are aligned with the keying positions on the second housing and assembled to the second housing. The carrier strip can then be separated from the remaining identical parts.

2 Claims, 10 Drawing Figures

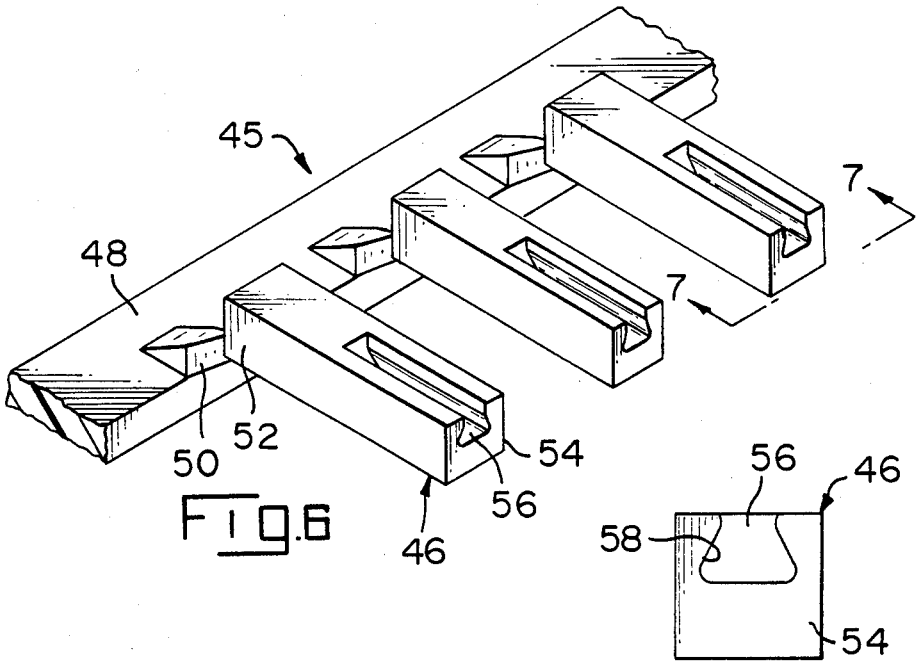
FIG.6
FIG.7
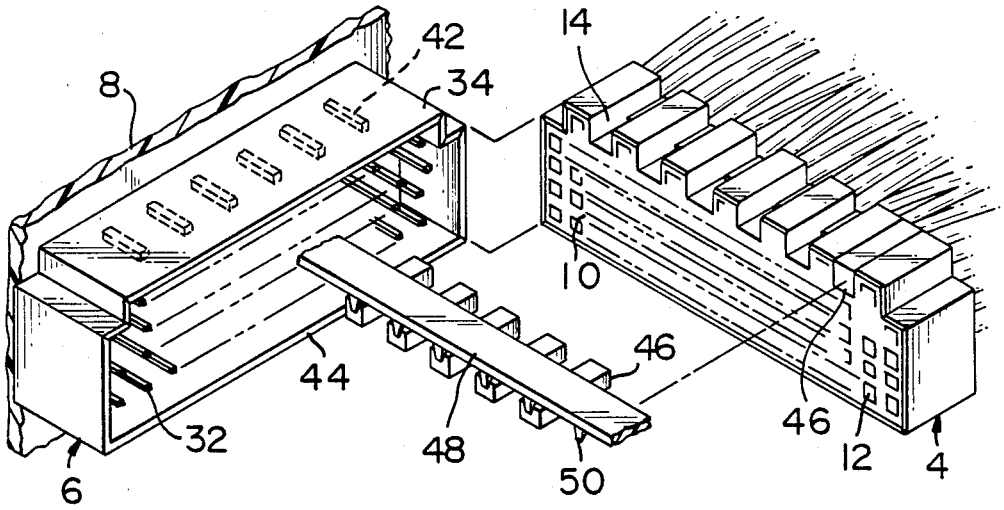
FIG.8

KEYING SYSTEM FOR ELECTRICAL CONNECTORS

FIELD OF THE INVENTION

This invention relates to keying systems for keying the two connector housings of a connector assembly to each other and to improved methods of assembling keys and keyway plugs to connector housings.

BACKGROUND OF THE INVENTION

It is common practice to provide keys and keyways on the two housings of an electrical connector assembly so that the two housings can be assembled or coupled to each other and one of the housings cannot coupled to an otherwise identical housing for which it is not intended. Ordinarily, the keys and the keyway plugs are produced as loose piece parts and the technician must select plugs and keys and assemble them to the two housings of a connector assembly in predetermined positions in order to key the parts to each other. The task of assembling the keyway plugs and the keys to the housings is time-consuming. Also, there is a distinct possibility that the technician will make an error in assembling the parts to the housings and that the desired keying effects will not be obtained. The present invention is directed to improved keys and keyways and to the achievement of an improved method of assembling keys and keyplugs to key mounting positions and keyways on electrical connector housings.

In accordance with one aspect thereof, the invention comprises an electrical connector assembly which consists of first and second connector housings, a plurality of keys, and a plurality of keyway plugs. The housings have mating faces which are opposed to each other when the housings are coupled to each other. A plurality of keyways extend inwardly from the mating face of the first connector housing and a plurality of key mounting positions are provided on the mating face of the second connector housing. The keys are dimensioned so that they can be slidably received in the keyways and are mountable at the mounting positions. The keyway plugs are capable of being permanently mounted in the keyways. The connector assembly is characterized in that the keyways and the key mounting positions are arranged in rows with the keyways and the key mounting positions spaced apart at predetermined intervals. The keyway plugs and the keys are identical parts and are in the form of a strip, the strip comprising a continuous carrier strip from which the identical parts extend normally of the length of the carrier strip. The identical parts are spaced apart at the same predetermined intervals as are the keyways and the key mounting positions. The identical parts are removably connected to the carrier strip so that the first connector housing can be keyed to the second connector housing by removing at least one of the identical parts from the strip and assembling the removed part or parts to one of the housings. Thereafter the remaining identical parts are assembled to the other connector housing.

In accordance with further aspects of the invention, each of the identical parts has mounting surface portions extending from one end thereof at least partially towards the other end. The key mounting positions and keyways have complementary mounting surface portions which are interengageable with the mounting surface portions of the identical parts. Each of the keyways and each of the key mounting positions has a rib extending normally of the associated mating face, the complementary mounting surface portions being the surfaces of the ribs. Each of the identical parts has an axially extending recess which conforms in cross section to the cross sections of the ribs. The mounting surface portions are thus the surfaces of the recesses.

In accordance with a further aspect, the invention comprises a plurality of keyway plugs and a plurality of keys which can be assembled to keyways in a first connector housing and to key mounting positions on a second connector housing respectively. The keyway plugs and the keys are identical parts and are provided as a strip which comprises a continuous carrier strip from which the identical parts extend laterally on a pitch which is the same as the spacing between the keyways on the first connector housing and the key mounting positions on the second connector housing. Each identical part on the strip has a proximate end which is proximate to the carrier strip and a remote end which is remote from the carrier strip. The identical parts are removably secured to the carrier strip at their proximate ends. Each of the identical parts also has an axially extending mounting surface portion which extends from the remote end thereof at least partially towards the proximate end.

A further aspect of the invention comprises a method of keying an electrical connector assembly which assembly comprises first and second connector housings. The housings have mating faces which are opposed to each other when they are coupled to each other. A plurality of keyway positions extend inwardly from the mating face of the first connector housing and a like plurality of key mounting positions are provided on the mating face of the second connector housing. The method comprises the steps of providing keys and keyways as identical parts in side-by-side strip form with the identical parts removably connected to a carrier strip and with the spacing between adjacent identical parts being the same as the spacing between adjacent positions in the first housing and adjacent positions in the second housing. The method further comprises the steps of detaching at least one of the identical parts from the carrier strip and assembling the detached part to one of the housings. Thereafter the remaining identical parts, while still attached to the carrier strip, are aligned with the positions on the other housing and assembled to the other housing. Finally, the carrier strip is broken away from or otherwise removed from the remaining identical parts.

THE DRAWING FIGURES

FIG. 1 is a cross-sectional view of a pair of connector housings in alignment with each other in preparation for mating, the upper portion of FIG. 1 being taken along the section lines 1—1 of FIG. 2 and the lower portion of FIG. 1 being taken along the section lines 1—1 of FIG. 3.

FIGS. 2 and 3 are views looking in the direction of the arrows 2—2 and 3—3 respectively of FIG. 1.

FIG. 6 is a perspective view of a section of a strip of identical parts which are usable as either keyway plugs or as keys.

FIG. 7 is a view looking in the direction of the arrows 7—7 of FIG. 6.

FIGS. 8, 9 and 10 are a series of perspective views which illustrate the method of assembling keyway plugs and keys to connector housings in accordance with the invention.

THE DISCLOSED EMBODIMENT

Figure 1:
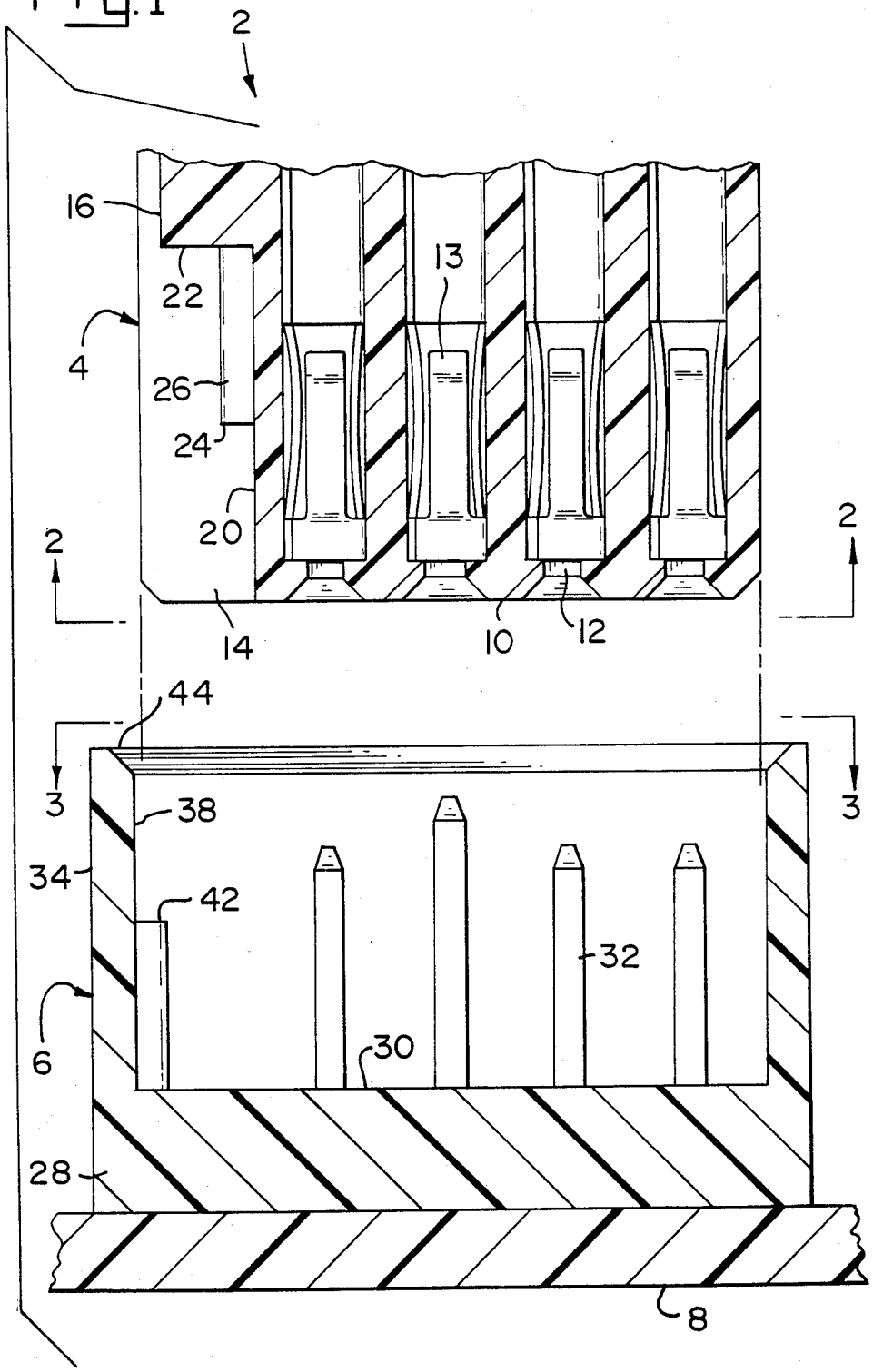
Figure 2:
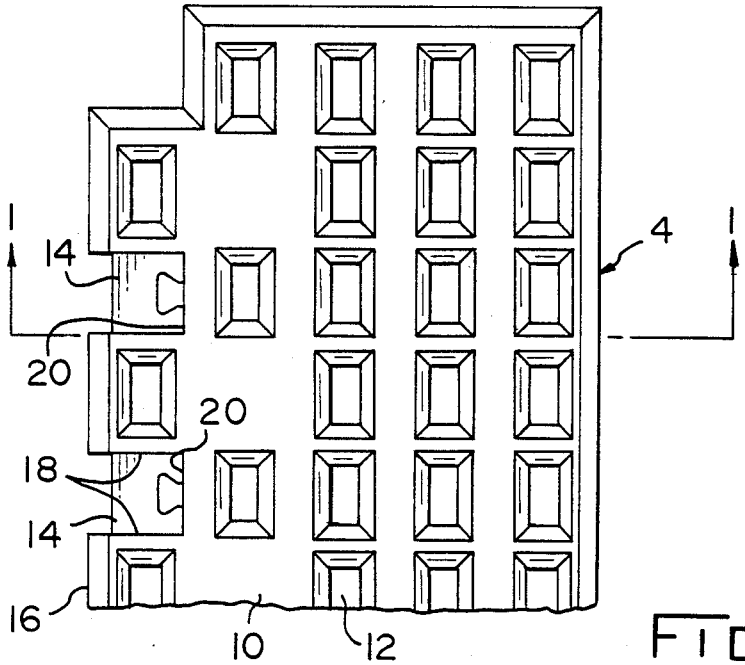
Figure 3:
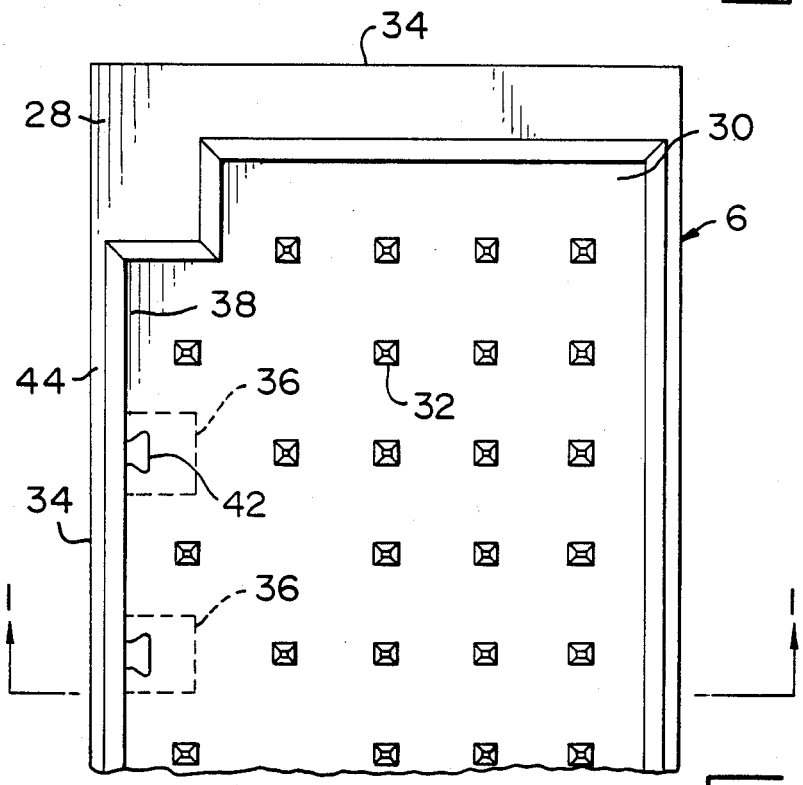

FIGS. 1–3 show a connector assembly 2 comprising a first connector housing 4 and a second connector housing 6. The second connector housing is mounted on the upper surface of a circuit board 8 and contact pins 32 in the second housing extend through the circuit board and may be soldered to conductors on the underside thereof. It will be understood that a plurality of connector assemblies as shown in FIG. 1 may be mounted in side-by-side relationship on the circuit board 8.

The first housing 4 has a mating face 10 into which a plurality of terminal receiving cavities 12 extend. These cavities will normally contain contact terminals 13 which receive the pins 32 when the parts are mated. A plurality of keyways 14 extend inwardly from the mating face and open onto an adjacent sidewall 16 of the housing 4. Each keyway has opposed sidewalls 18, an inner wall 20, and an end wall 22 which is spaced inwardly from the mating face 10. A mounting rib 24 is provided in each keyway and extends from the end wall 22 partially towards the mating face 10. The surface 26 of each mounting rib functions as a complementary mounting surface as will be explained below.

The second housing 6 comprises a body portion 28 having a mating face 30 from which the previously-identified contact pins 32 extend. A hood 34 surrounds the mating face and receives forward portions of the housing 4 when the two housings are coupled to each other. A plurality of key mounting positions 36 are provided on the mating face and are opposed to the keyways 14. A rib 42, which is identical to the rib 24, is provided at each key mounting position and is against an internal wall 38 of the hood 34. The end of each key is spaced inwardly from the outer end 44 of the hood.

FIGS. 6 and 7 show a strip 45 of identical parts 46 which are usable as either keyway plugs or as keys. The strip comprises a carrier strip 48 and the identical parts 46 extend laterally from the carrier strip as spaced-apart intervals which are the same as the intervals between adjacent keyways or adjacent key mounting positions in the connector housings 4, 6. Each identical part 46 has a proximate end 52 which is proximate to the carrier strip and which is connected to the carrier strip by a connecting section 50. The connecting section is such that the individual parts can be broken therefrom as illustrated in FIGS. 8–10.

Each identical part 46 also has a remote end 54 which is remote from the carrier strip 48. A recess 56 extends inwardly from the remote end partially towards the proximate end 52. This recess conforms to the cross sections of the ribs 24, 42 so that the recesses can receive the ribs. The surfaces 58 of the recesses thus serve as mounting surfaces.

In the disclosed embodiment, the identical parts 46 have a square cross section and, excepting for the recesses or slots 56, the cross section is uniform throughout the length of each identical part.

Figure 9:
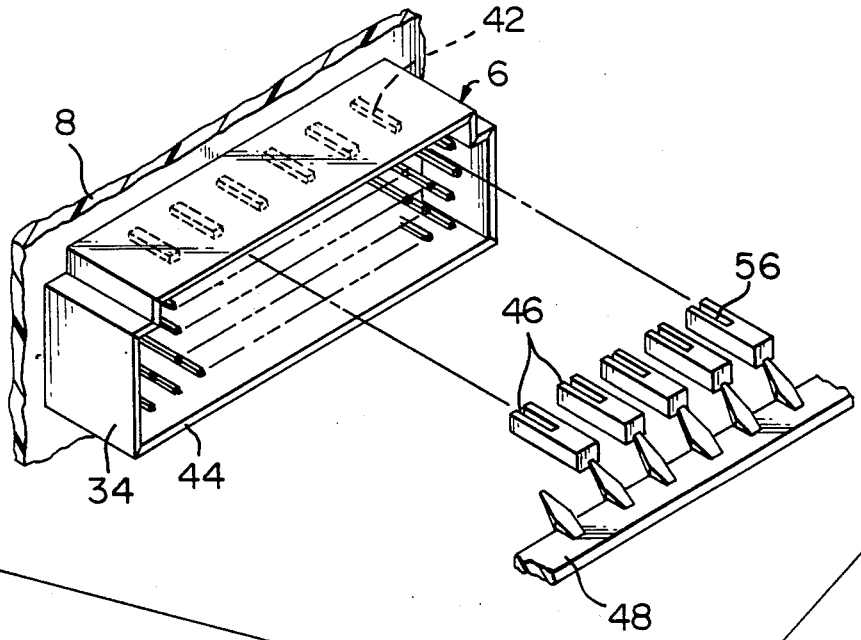
Figure 10:
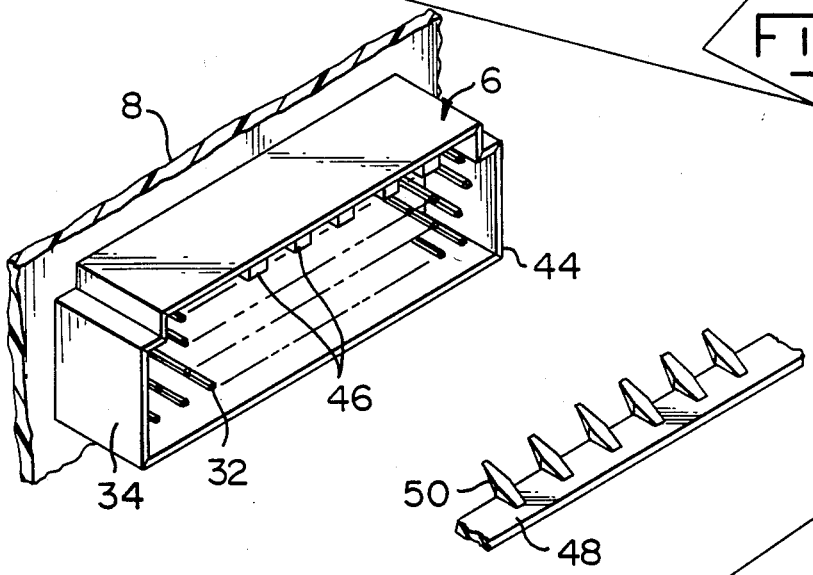

The preferred method of assembling the identical parts to the housings 4, 6 is shown in FIGS. 8–10. The strip is preferably produced as a continuous molded plastic strip and a section is cut from the continuous length which has a number of identical parts 46 thereon which is the same as the number of keyways and key mounting positions in the housings 4, 6. One or more of the identical parts are separated from the carrier strip 48 and assembled to predetermined keyways in the housing 4 so that these parts serve as keyway plugs. The section of strip is then positioned in front of the housing 6 with the identical parts in alignment with the key mounting positions on the mating face of housing 6. The strip is moved towards the mating face so that the ribs on the mating face of housing 6 enter the recesses or grooves in the strip. Thereafter, the carrier strip 48 is broken away from the remaining parts which now serve as keys. It will be apparent that the assembly of the parts 46 to the housings 4, 6 can be carried out in a very short time and the possibility of an error occuring is greating reduced by the practice of the invention.

Figure 4:
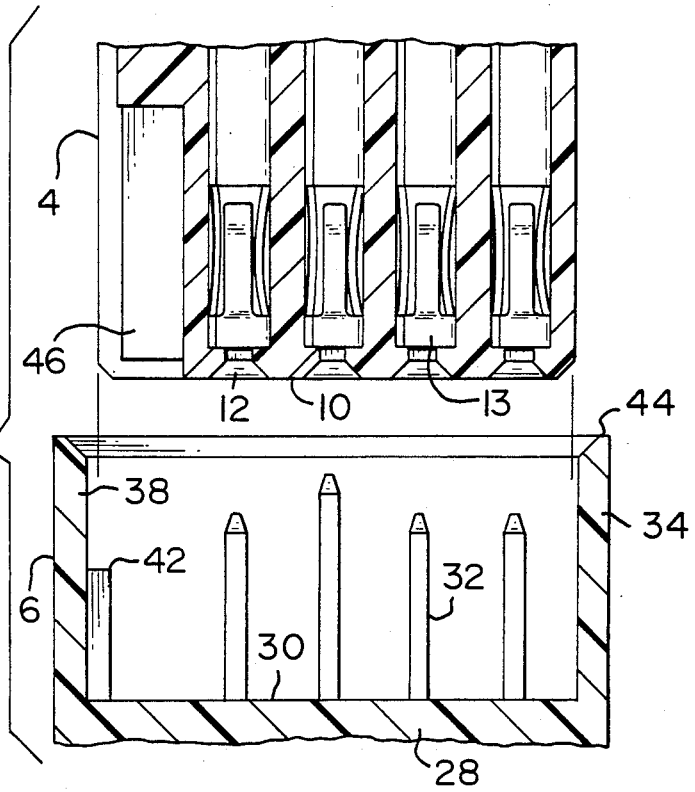
FIG. 4 is a view similar to FIG. 1 but showing a keyway plug installed in a keyway in the upper connector housing.
Figure 5:
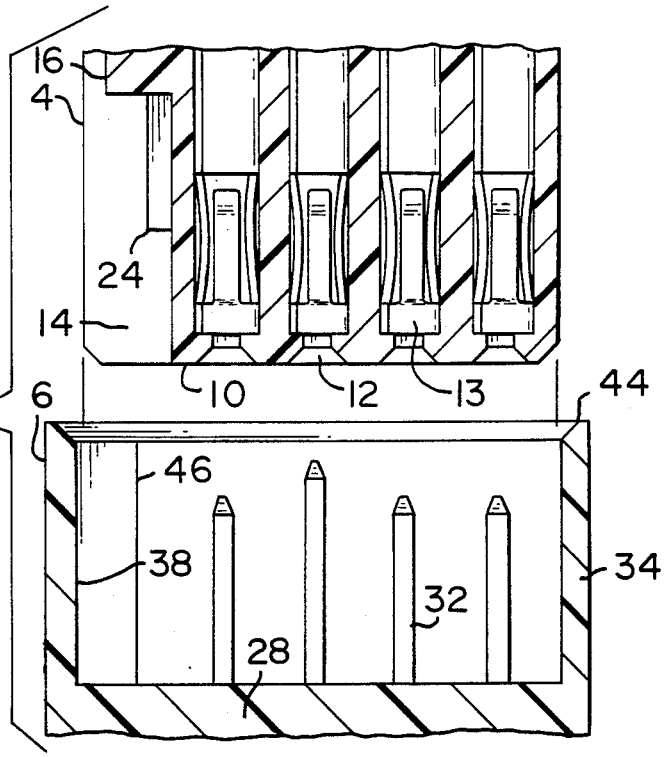
FIG. 5 is a view similar to FIG. 4 but showing a key installed at one of the key mounting positions of the lower connector housing.

As will be apparent from FIGS. 4 and 5, the ribs 24, 42 must be dimensioned such that they will no interfere with the keyway plugs or keys which are assembled to the housings. In other words, upon downward movement of the housing 4 from the position of FIG. 4, the keyplug will not engage the rib 42 in the housing 6. Similarly, upon downward movement of the housing 4 from the position shown in FIG. 5, the rib 24 in the keyway will not engage the key which has been assembled to the corresponding key mounting position of the lower housing.

I claim:

1. An electrical connector assembly comprising first and second rectangular connector housings, a plurality of keys and a plurality of keyway plugs, the housings having mating faces which are opposed to each other when the housings are coupled to each other, a plurality of keyways extending inwardly from the mating face of the first connector housing and a plurality of key mounting positions on the mating face of the second connector housing, the keys being dimensioned so that they can be slidably received in the keyways and being mountable at the mounting positions, the keyway plugs being permanently mountable in the keyways, the connector assembly being characterized in that:

the keyways and the key mounting positions are arranged in rows with the keyways and the key mounting positions spaced apart at predetermined intervals, each of the keyways and each of the key mounting positions has a rib extending normally of the associated mating face, the keyway plugs and the keys are identical parts and are in the form of a strip, the strip comprising a continuous carrier strip from which the identical parts extend normally of the length of the carrier strip, the identical parts being spaced apart at the same predetermined intervals as are the keyways and the key mounting positions, the identical parts being removably connected to the carrier strip, each of the identical parts having an axially extending recess which conforms in cross section to the cross sections of the ribs, each of the identical parts having a proximate end which is proximate to the carrier strip and a remote end which is remote from the carrier strip, the recess in each identical part extending from the remote end towards the proximate end, whereby, the first connector housing can be keyed to the second connector housing by removing at least one of the identical parts from the strip and assembling the removed part or parts to one of the connector housings and thereafter assembling the remaining identical parts to the other connector housing, the carrier strip being used as a part holder when the identical parts are assembled to the other connector housing.

2. An electrical connector assembly as set forth in claim 1 characterized in that the rib in each of the keyways in the first housing is offset relative to the rib at the corresponding key mounting position on the mating face of the second housing, the identical parts being dimensioned to provide clearance between a keyway plug in a keyway in the first housing and the ribs in the corresponding key mounting position on the mating face of the second housing and to provide clearance between a key mounted at a key mounting position on the second housing and the ribs in the corresponding keyway of the first housing.

* * * * *